US010973348B2

(12) United States Patent
Calderaio

(10) Patent No.: US 10,973,348 B2
(45) **Date of Patent: *Apr. 13, 2021**

(54) SINGLE-SERVE BEVERAGE CUP

(71) Applicant: Calderco Holdings Group, LLC, North Palm Beach, FL (US)

(72) Inventor: John P. Calderaio, North Palm Beach, FL (US)

(73) Assignee: Calderco Holdings Group, LLC, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/834,245

(22) Filed: Mar. 30, 2020

(65) Prior Publication Data

US 2020/0221890 A1 Jul. 16, 2020

Related U.S. Application Data

(63) Continuation of application No. 15/861,481, filed on Jan. 3, 2018, now Pat. No. 10,638,862.

(60) Provisional application No. 62/542,937, filed on Aug. 9, 2017, provisional application No. 62/525,525, filed on Jun. 27, 2017, provisional application No. 62/442,304, filed on Jan. 4, 2017.

(51) Int. Cl.

| | |
|---|---|
| ***A47G 19/22*** | (2006.01) |
| ***B65D 1/26*** | (2006.01) |
| ***B65D 77/04*** | (2006.01) |

(52) U.S. Cl.

CPC ..... *A47G 19/2205* (2013.01); *B65D 1/265* (2013.01); *B65D 77/0493* (2013.01)

(58) Field of Classification Search

CPC ..... A47G 19/00–2205; B65D 77/00–0493; B65D 1/00–265; B65D 25/24; B65D 81/3216; B65D 51/20; B65D 81/3222; B65D 81/3233; B65D 77/0486; B65D 77/06; B65D 77/062; B65D 77/0493; B65D 77/2032; A47J 43/27

USPC ..... 220/500, 505, 23.83, 23.89, 23.86, 574, 220/592.17, 703; 215/378, 386, 387, 395, 215/6, 376; 206/217; 426/86

See application file for complete search history.

(56) References Cited

U.S. PATENT DOCUMENTS

| | | | | |
|---|---|---|---|---|
| 1,829,664 A | | 10/1931 | McKay | |
| D86,379 S | | 3/1932 | Kizinski | |
| 2,120,862 A | | 6/1938 | Heller | |
| 2,187,558 A | * | 1/1940 | Kushima | A47G 19/2288 215/12.1 |

(Continued)

FOREIGN PATENT DOCUMENTS

| | | |
|---|---|---|
| DE | 8130690 U1 | 3/1982 |
| FR | 2759976 A1 | 8/1998 |

(Continued)

OTHER PUBLICATIONS

"Reclaimed Wine Bottle Glasses", Green Head, Mar. 12, 2015 (5 Pages).

*Primary Examiner* — Kareen K Thomas

(74) *Attorney, Agent, or Firm* — Breiner & Breiner, L.L.C.

(57) ABSTRACT

A single serve beverage cup, including for wine, is disclosed having a base, a bowl, a seal and a cover. The container may also include an outer package and an inner package. There is also disclosed a single serve beverage cup having a cavity for receiving a miniature liquor bottle for making a cocktail.

37 Claims, 13 Drawing Sheets

(56) References Cited

U.S. PATENT DOCUMENTS

| | | | | |
|---|---|---|---|---|
| D124,555 | S | 1/1941 | Platt | |
| 2,328,872 | A * | 9/1943 | Yealdhall | B65D 85/816 206/217 |
| D138,638 | S | 8/1944 | Erbe | |
| 2,665,571 | A | 1/1954 | Lochead | |
| D173,106 | S | 9/1954 | Foster | |
| 3,565,281 | A | 2/1971 | Collie | |
| 4,410,085 | A | 10/1983 | Beneziat et al. | |
| 4,416,370 | A | 11/1983 | Beall | |
| 5,271,508 | A | 12/1993 | Gamwell | |
| 5,673,789 | A * | 10/1997 | Degraff-Eugene | A47G 19/2205 206/217 |
| 5,769,680 | A | 6/1998 | Hoffman | |
| 5,996,781 | A | 12/1999 | Glaser | |
| 6,066,021 | A | 5/2000 | Lee | |
| D448,619 | S | 10/2001 | Pau | |
| 6,520,543 | B1 | 2/2003 | Hoar | |
| 6,964,492 | B1 | 11/2005 | Nicklowitz | |
| D533,405 | S | 12/2006 | Barducci | |
| D560,098 | S | 1/2008 | Barducci | |
| 7,322,466 | B2 | 1/2008 | Alonso | |
| D615,363 | S | 5/2010 | Lion et al. | |
| D623,477 | S | 9/2010 | Ross | |
| 7,845,489 | B2 * | 12/2010 | Thompson | A47G 19/2227 206/217 |
| 7,845,512 | B2 | 12/2010 | Skala | |
| D704,002 | S | 5/2014 | Gooris | |
| D729,013 | S | 5/2015 | Riedel | |
| D731,855 | S | 6/2015 | Riedel | |
| D742,173 | S | 11/2015 | Perman | |
| D760,030 | S | 6/2016 | Wilson et al. | |
| D792,157 | S | 7/2017 | Di Giuseppantonio | |
| D809,345 | S | 2/2018 | Calderaio | |
| 10,638,862 | B2 | 5/2020 | Calderaio | |
| 2005/0139570 | A1 | 6/2005 | Lambert et al. | |
| 2006/0273087 | A1 | 12/2006 | Crawford | |
| 2007/0158356 | A1 | 7/2007 | Cunningham | |
| 2008/0023348 | A1 | 1/2008 | Herzog et al. | |
| 2008/0042422 | A1 | 2/2008 | Maluso | |
| 2010/0294770 | A1 | 11/2010 | Wing et al. | |
| 2011/0132781 | A1 | 6/2011 | Willat et al. | |
| 2012/0043243 | A1 * | 2/2012 | Selina | B65D 81/3876 206/459.5 |
| 2013/0313220 | A1 | 11/2013 | Scott | |
| 2014/0048204 | A1 * | 2/2014 | Hunter | B32B 37/185 156/277 |
| 2014/0165847 | A1 | 6/2014 | Suprina | |
| 2014/0332495 | A1 | 11/2014 | Choi et al. | |
| 2014/0374374 | A1 | 12/2014 | Scott | |
| 2015/0069056 | A1 | 3/2015 | Kishimoto et al. | |
| 2015/0183626 | A1 | 7/2015 | Protzman | |
| 2015/0305532 | A1 | 10/2015 | Fishbone | |
| 2016/0353909 | A1 | 12/2016 | Fishbone | |
| 2017/0251849 | A1 | 9/2017 | Zanatta et al. | |
| 2018/0092478 | A1 | 4/2018 | Wilson et al. | |
| 2018/0132638 | A1 | 5/2018 | Bergida et al. | |

FOREIGN PATENT DOCUMENTS

| | | | |
|---|---|---|---|
| GB | 2289252 | A | 11/1995 |
| GB | 2385577 | A | 8/2003 |
| WO | 2007056815 | A1 | 5/2007 |

* cited by examiner

SINGLE-SERVE BEVERAGE CUP

RELATED APPLICATIONS

This application is a continuation and claims benefit of U.S. nonprovisional application Ser. No. 15/861,481, filed Jan. 3, 2018, entitled "Single-Serve Beverage Cup," which claims benefit of U.S. provisional application Ser. No. 62/442,304, filed Jan. 4, 2017, entitled "Cup;" U.S. provisional application Ser. No. 62/525,525, filed Jun. 27, 2017, entitled "Cup;" and U.S. provisional application Ser. No. 62/542,937, filed Aug. 9, 2017, entitled "Cup;" each of these applications incorporated herein by reference in their entirety.

FIELD OF THE INVENTION

The present invention relates to a cup. More particularly, the invention relates to a single serve beverage cup, including a single serve beverage cup for wine and cocktails, and methods of filling the cup.

BACKGROUND OF THE INVENTION

Single serve beverage containers for wine are known in the art. For example, single serve beverage containers for wine include a base, a stem and a bowl for containing the wine. Such containers are not suitable for certain activities including at outdoor events such as concerts or sporting events as they do not fit into cup holders, they tip over easily and are subject to breaking at the stem. Other single serve beverage containers for wine are known such as pouches. Such containers are not attractive and are not particularly palatable when drinking a fine wine. Accordingly, there is a need in the market for a single serve beverage cup for wine which is easy to grasp; is stable and not subject to tipping over or breakage; is aesthetically pleasing; is easy to drink from; is easy to manufacture and fill; and provides additional benefits over the known containers.

SUMMARY OF THE INVENTION

A primary object of the present invention is to provide a single serve beverage cup.

Another primary object of the present invention is to provide a single serve beverage cup for wine.

Another primary object of the present invention is to provide a single serve beverage cup for wine which is suitable for a person to enjoy wine similar to drinking from a fine wine glass.

Another primary object of the present invention is to provide a single serve beverage cup for wine which is stable and not subject to tipping over.

Another primary object of the present invention is to provide a single serve beverage cup for wine which is easy to grasp for both men and women having different size hands.

Another primary object of the present invention is to provide a single serve beverage cup for wine which is easy to grasp and precludes heating of the wine by a person's hand.

Another primary object of the present invention is to provide a single serve beverage cup for wine which is easy to manufacture and fill, including providing the required head space in the cup after the cup is filled with wine.

Another primary object of the present invention is to provide a single serve beverage cup for wine which includes an outer package and an inner package.

Another primary object of the present invention is to provide a single serve beverage cup for wine having a base portion which appears frosted and may include a brand logo.

Another primary object of the present invention is to provide a single serve beverage cup for wine which includes a base having an opening in its underside which provides a number of benefits including allowing the cooling of wine in a cooler or using the open area in the base for storage of a material.

Another primary object of the present invention is to provide a single serve beverage cup for wine having a bowl area for receiving a cover for storage of the wine wherein the bowl area has a diameter greater than the diameter of the base of the cup, and wherein the cover may be used as a coaster for the cup.

Another primary object of the present invention is to provide a cup having a base which holds a miniature liquor bottle.

Another primary object of the present invention is to provide a cup having a base which holds a miniature liquor bottle and a bowl which is filled with a cocktail mix such that the liquor bottle may be removed from the base and the liquor poured into the cocktail mix to provide a cocktail.

Another primary object of the present invention is providing a single serve beverage cup which may be filled on a conventional wine filling line.

Another primary object of the present invention is providing a single serve beverage cup for wine and a method of filling the cup with wine.

The cup of the invention comprises a base, a bowl, a seal and a cover. The diameter of the base decreases from the base bottom wall to the bottom of the bowl. The bowl increases in diameter from the bottom of the bowl to the top of the bowl. The base includes an open area in the base. The seal may be, but is not limited to, an induction heat seal.

The cup of the invention further comprises a base, a bowl, a seal and a cover. The diameter of the base decreases from the base bottom wall to the bottom of the bowl. The bowl increases in diameter from the bottom of the bowl to the top of the bowl. The base includes an open area in the base. The bowl may include a punt allowing for, among other things, control over the volume of liquid in the cup and the head space in the cup. The seal may be, but is not limited to, an induction heat seal.

The cup of the invention further comprises a base, a bowl, a seal and a cover. The diameter of the base decreases from the base bottom wall to the bottom of the bowl. The bowl increases in diameter from the bottom of the bowl to the top of the bowl. The base includes an open area in the base. The bowl may include a cavity for receiving a miniature liquor bottle for making a cocktail. The bowl may include a cocktail mix for mixing with the liquor in the miniature liquor bottle. The base includes a closure to retain the miniature liquor bottle in the cup. The seal may be, but is not limited to, an induction heat seal.

The cup of the invention further comprises an outside packaging and an inside packaging. The outside packaging preferably covers the entire cup and may include product information such as a brand, logo, information on the contents of the cup and similar information. When the cup is to be used, the outside packaging is removed and there is an inside packaging providing information concerning, among other things, the contents of the cup and branding information.

The invention further includes a cup having an aperture in the bottom of the bowl for filling a beverage into the cup in a conventional filling line such as a wine filling line.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings.

DETAILED DESCRIPTION OF THE PREFERRED EMBODIMENTS

The present invention is directed to a single serve beverage cup. More specifically, the present invention is directed to a single serve beverage cup for wine or a cocktail. The invention will be described herein with respect to a single serve cup for wine or a cocktail. However, it is understood that the invention may be useful with other beverages or contents.

Single serve containers for wine have become popular among consumers, especially consumers of fine wines. For example, some people wish to have a glass of wine and do not wish to open a whole bottle of wine which may not save well over time. Additionally, single serve containers for wine have become popular at events such as concerts and sporting events. Consumers of single serve containers for wine, however, desire to have a container having the attributes of a wine glass in order to more fully enjoy the experience of sipping the wine. The single serve cup must, therefore, be easy to open and sip the wine from. The lip of the cup must be such that the wine may be enjoyed, e.g. there are no threads on the cup lip interfering with the sipping of the wine. Similarly, the wine cup must be easy to hold and feel comfortable in the user's hand. The wine cup should be easy to grasp below the bowl of the cup such that it is easy to sip the wine, and the person's hand need not grasp the bowl of the cup thereby heating the wine making the wine less pleasing to drink. The cup must also be such that when used at outdoor events it will be stable and not tip over, may fit into a cup holder, will not break at the stem, and the lip of the cup allowing for comfort in sipping the wine. Similarly, the dimensions and weight of the cup must be such that it is sufficiently heavy to make the cup sturdy and similar to drinking out of a wine glass. The present invention addresses these various aspects of a single serve beverage cup, including for wine and cocktails.

Figure 6B:
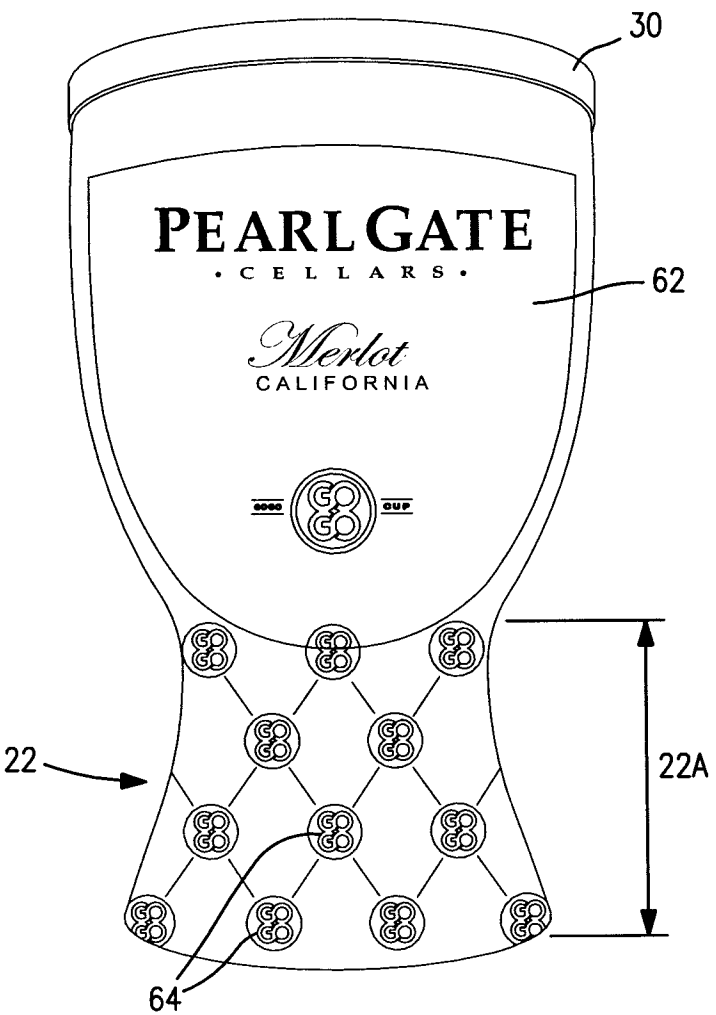
FIG. 6B is a view of the cup of FIG. 6A having the outer package removed from the cup and showing an inner package of the cup.
Figure 6A:
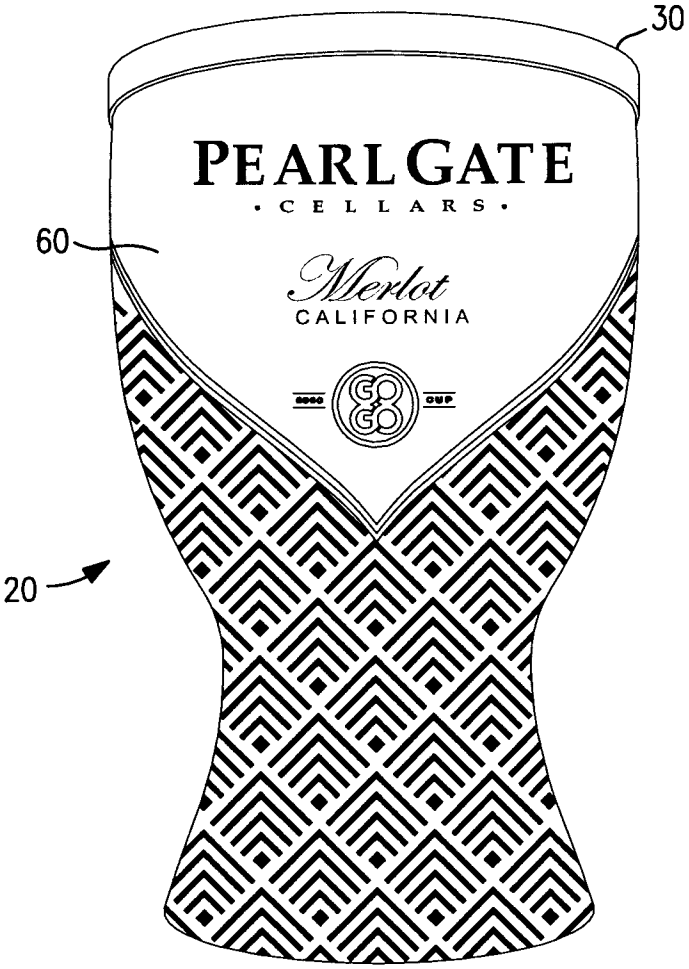
FIG. 6A is a side elevational view of the invention of FIG. 1 showing a cover on the cup and an outer package surrounding the cup.
Figure 8:
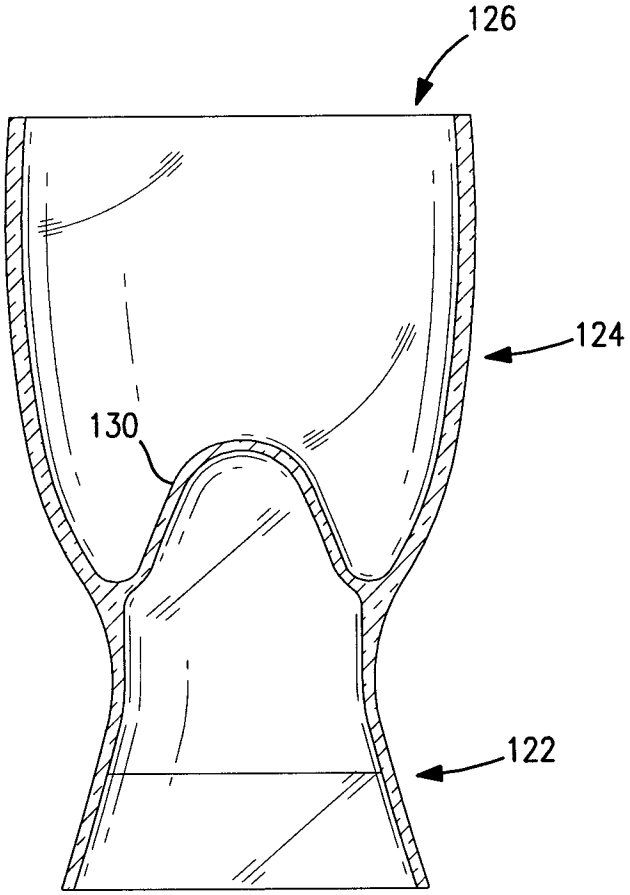
FIG. 8 is a cross-section of the cup of FIG. 7 taken along line 8-8 of FIG. 7.
Figure 9:
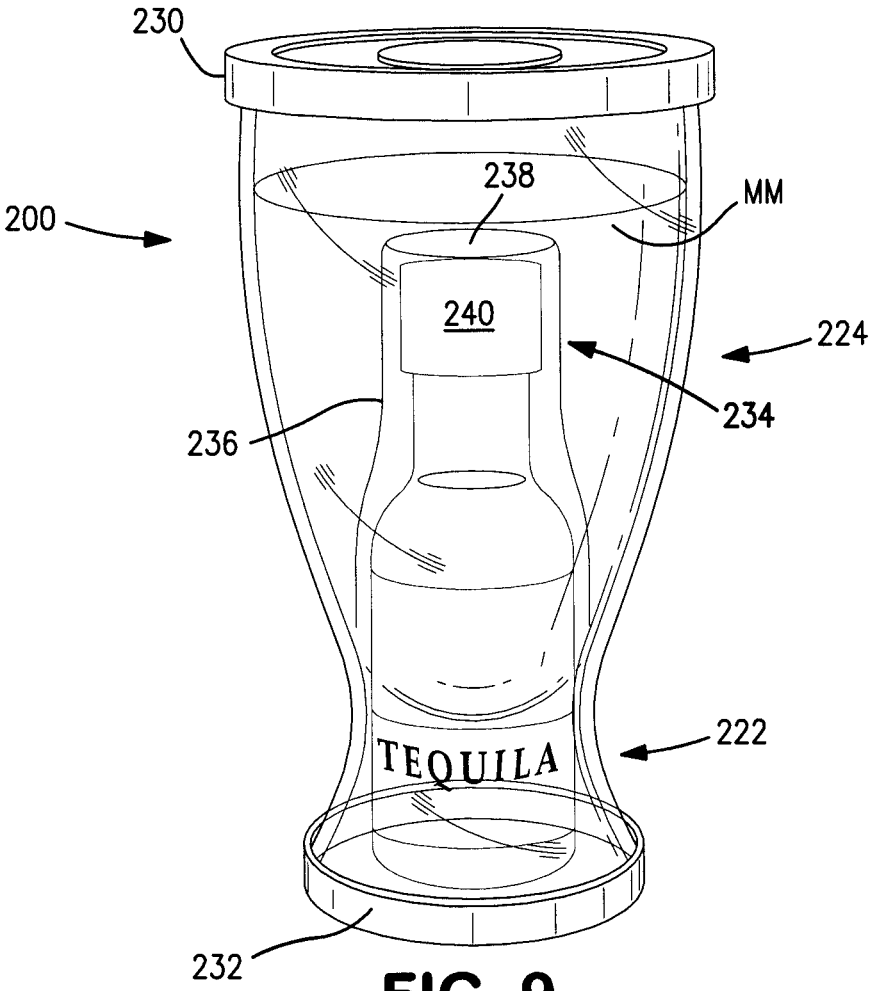
FIG. 9 is another embodiment of the invention showing a perspective view of a cup having a cavity for receiving an article such as a miniature liquor bottle.
Figure 11:
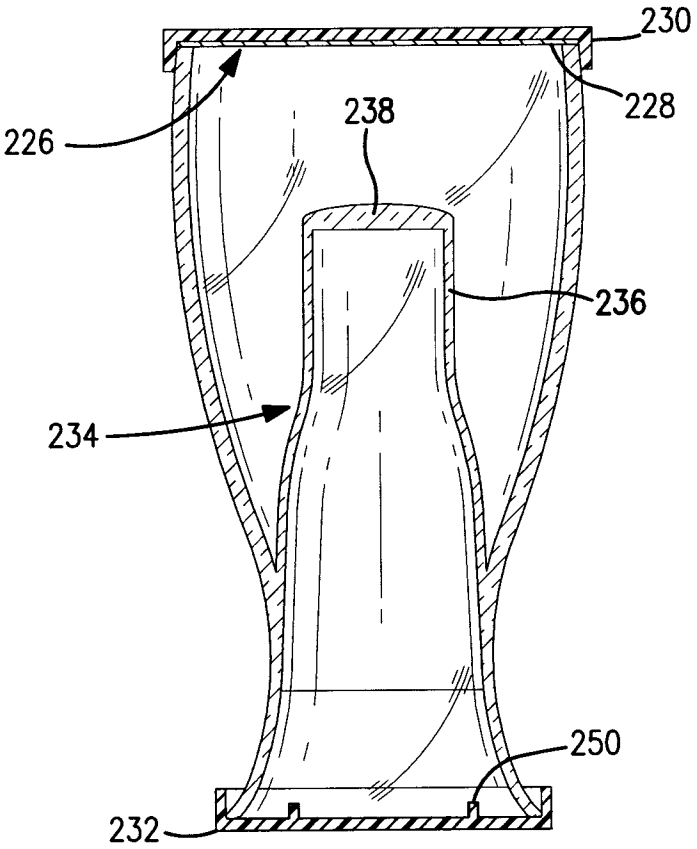
FIG. 11 is a cross-section of the cup of FIG. 10 taken along line 11-11 of FIG. 10 without the miniature liquor bottle.
Figure 10:
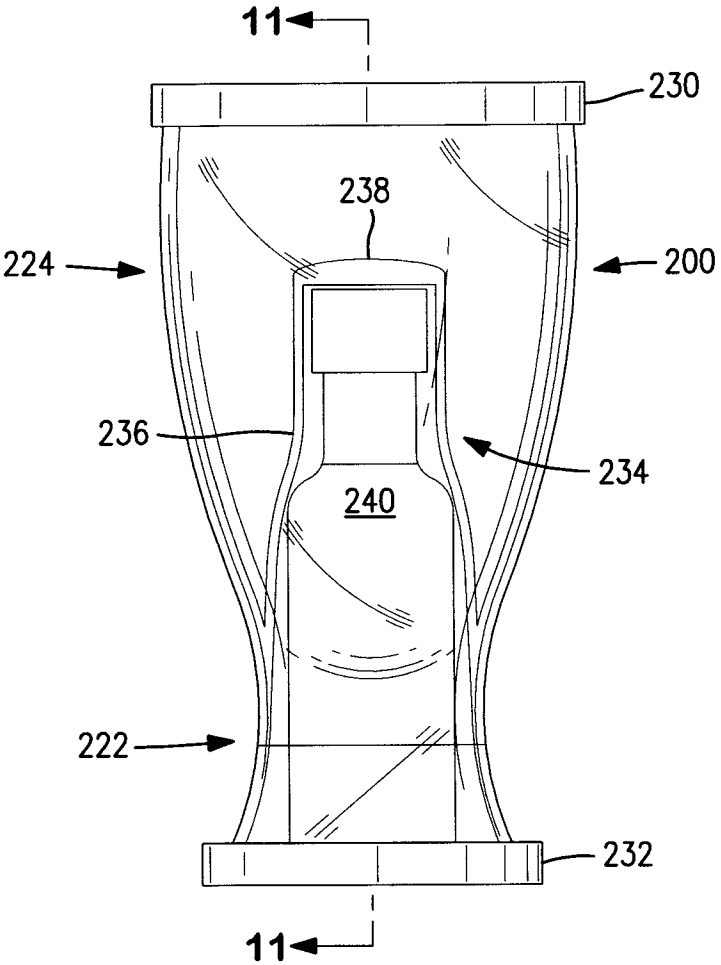
FIG. 10 is a side view of the cup of FIG. 9.

FIGS. 1-6 disclose one preferred embodiment of the single serve beverage cup of the present invention. It is understood that the cup may have varying dimensions in size without departing from the scope of the invention as discussed below. The invention will first be described primarily with respect to FIGS. 1-6. FIGS. 7 and 8 show a further embodiment of the invention. FIGS. 9, 10 and 11 illustrate a still further embodiment of the invention. FIGS. 12-15 illustrate a manner of filling the cups of FIGS. 1-8 from the bottom of the bowl of the cup in a conventional wine filling line.

Referring to FIGS. 1-6, the single serve beverage cup 20 includes a base 22, a bowl 24, an opening 26, a seal 28 and a cover 30. The cup 20 is filled with wine in accordance with manufacturing standards and generally 187 milliliters, comparable to a quarter bottle of a 750 milliliter bottle of wine. There is approximately 0.4 inches to 0.57 inches head space between the cover 30 of the cup and the inside of bowl 24, a presently preferred head space being about 0.55 inches. Once the wine is filled, the cup 20 is sealed with a seal 28 and a cover 30 as described in further detail below.

The cup 20 includes a base 22 having a bottom wall 40, a side wall 42, an opening 44 and a top wall 46 which is the outside portion of the bottom of the bowl 24 as discussed below.

In a presently preferred embodiment, the base 22 of the cup may have the following dimensions: a height from the bottom wall 40 to the top wall 46 in the range of about 1.340 to 1.344 inches; a diameter at the bottom wall in the range of about 2.25 to 2.35 inches. The diameter of bottom wall 40 is smaller than the diameter at the top wall or lip 54 of side wall 50 of bowl 24. Accordingly, the diameter of the base 22 decreases from the bottom wall 40 of the base to the top region 46 of the base.

In a preferred embodiment, the opening 44 may provide a number of functions. For example, when the cup 20 is unopened and stored in a cooler, the ice or the ice water in the cooler will enter the opening 44 and cool the wine. In the alternative, the base 22 may serve as a storage space for another item; e.g.: (1) a piece of chocolate candy for eating when drinking a red wine; or (2) a liquid such as alcohol to provide a "shot" in the base for a "double" fill; or (3) a miniature liquor bottle (e.g. one shot) wherein the cup bowl may contain a cocktail mix and the liquor from the liquor bottle is taken from the base and mixed with the cocktail mix (in such case the bottom of the cup bowl may be configured to receive the liquor bottle, e.g. the neck of the liquor bottle extending upward into the molded bottom of the cup bowl or the molded bottom of the cup bowl may include means to engage and fixedly secure the bottle to the cup bowl such as male and female threads or a tongue and groove mechanism). As discussed below, FIGS. 9-11 show the invention with a miniature liquor bottle. In such instances, the base 22 may include a closure at the bottom wall 40 (not shown) to hold the material such as candy or a liquid or a liquor bottle or any other item, e.g. a charm to be placed on the cup base. Similarly, as shown in FIG. 6B, the base 22 may be frosted in the region generally referred to as 22A to give the appearance of a frosted container; or when an item is stored in the base, hiding the visibility of the item; or may include a brand or logo or combinations thereof; or a combination of the above.

Bowl 24 includes side wall 50, a bottom wall 52, and a top wall or lip 54. Lip 54 is preferably made of a thin dimension, e.g. to simulate drinking out of a wine glass for the greater enjoyment of the wine. Lip 54 is also constructed and arranged to receive seal 28 after the cup 20 is filled with wine. In a presently preferred embodiment, the bowl 24 of the cup may have the following dimensions: a height from the bottom wall 52 to the top wall 54 in the range of about 2.70 to 2.90 inches; and a diameter at the top wall 54 in the range of about 2.80 to 2.90 inches. The diameter at top wall 54 is greater than the diameter at the bottom wall 40 of base 22.

In a presently preferred embodiment, the cover 30 and a foil seal 28 is sealed to the bowl 24 by induction sealing means. More specifically, the foil seal 28 is an induction sealing foil which is attached to the underside of the cover 30. Cover 30 is sealed to bowl 24 by induction sealing. In this process, cover 30 is placed on bowl 24 and pressed onto the container under pressure. It is understood, however, that other materials may be used for the seal such as plastic or paper when not using an induction sealing process. In another preferred embodiment, cover 30 may snap onto the cup, for example, by having a rib in cover 30 and groove in the outside of bowl 24 (not shown) or vice versa. Other known snap-on members and/or closure members may be used for connecting the cover 30 with foil 28 to bowl 24, e.g. by friction fit. While not presently preferred, a screw cover may be used, preferably where the screw threads on the bowl do not interfere with sipping the wine.

Figure 1:
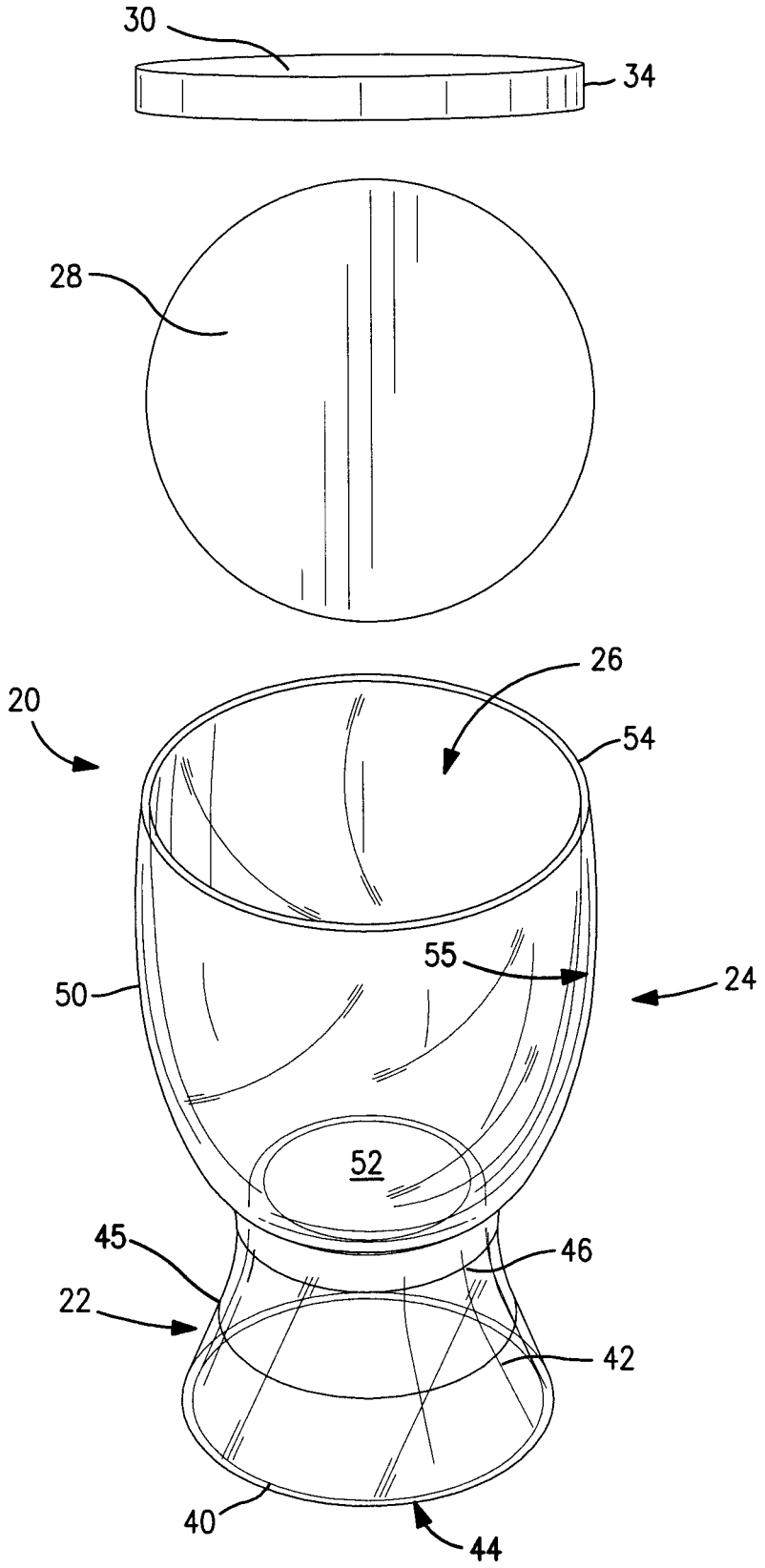
FIG. 1 is a side elevational exploded perspective view of the cup of the present invention.
Figure 2:
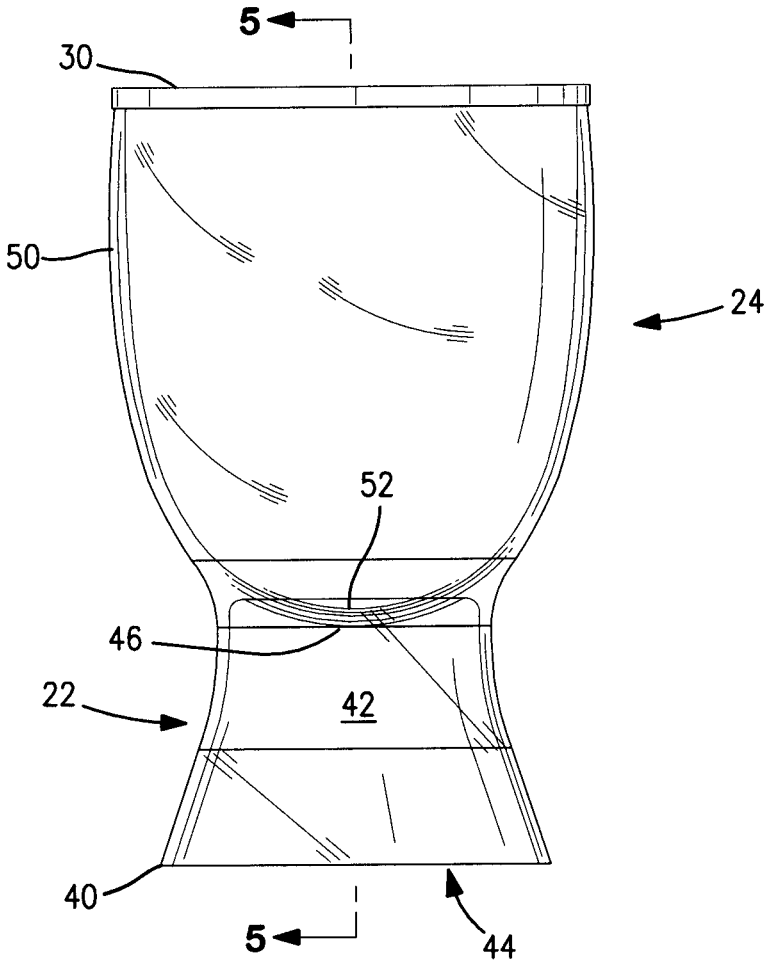
FIG. 2 is a side view of the cup of FIG. 1.
Figure 3:
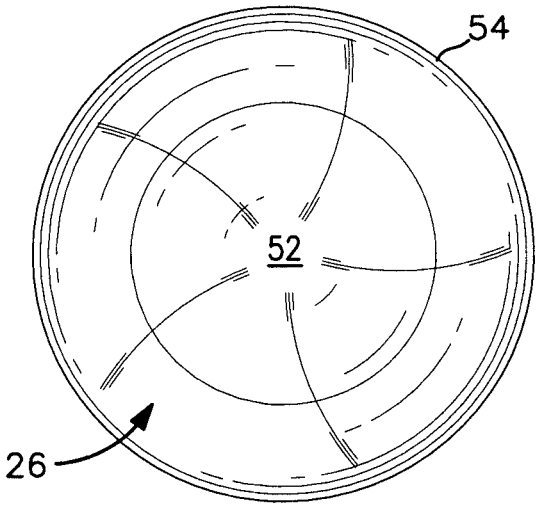
FIG. 3 is a top view of the cup of FIG. 1.
Figure 4:
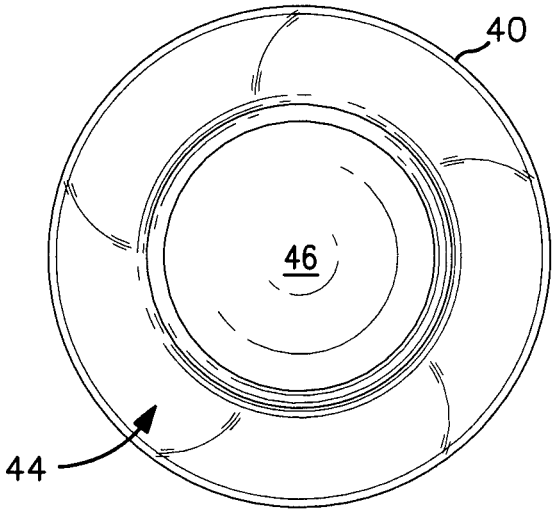
FIG. 4 is a bottom view of the invention of FIG. 1.
Figure 5:
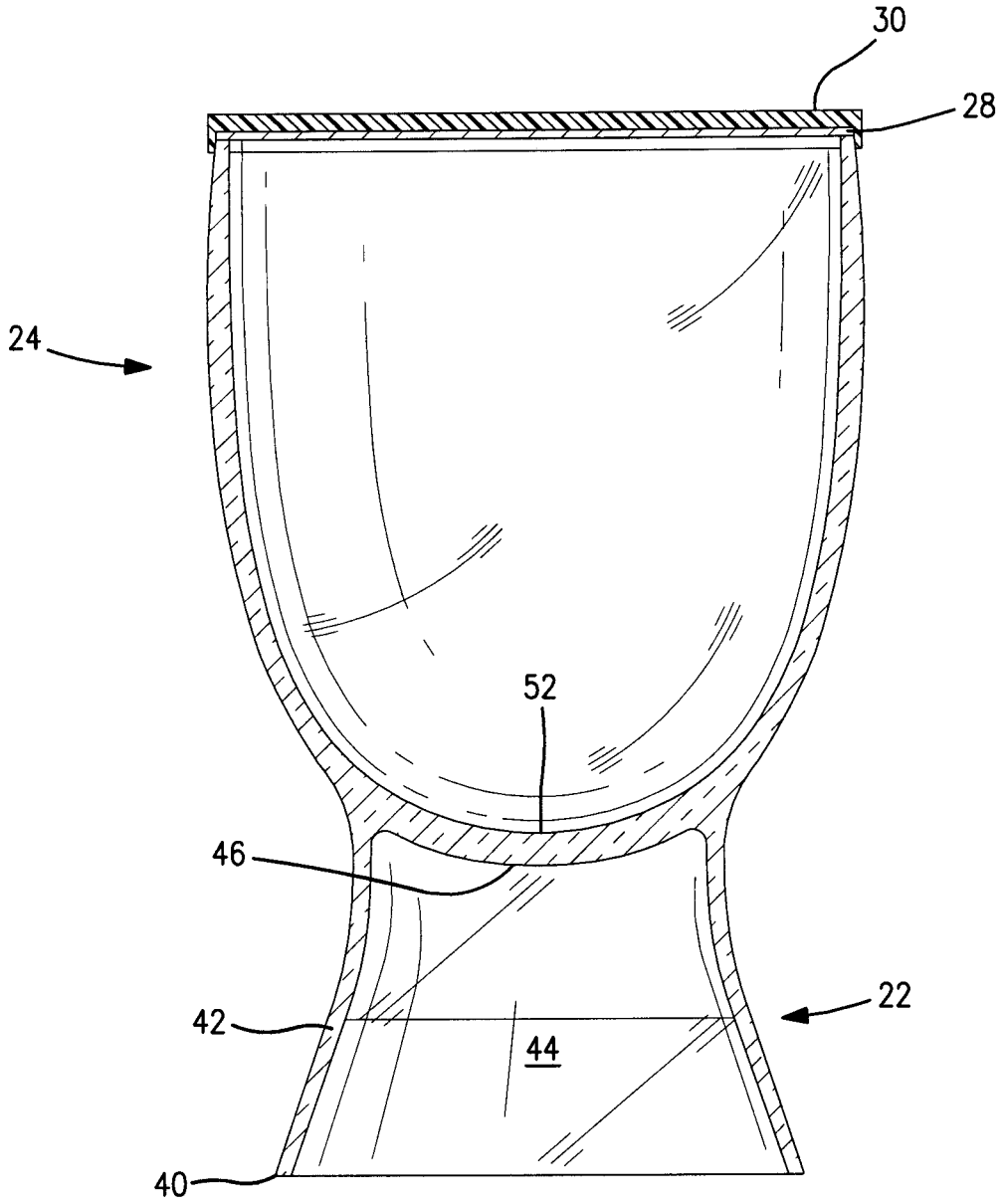
FIG. 5 is a cross-section taken along line 5-5 of FIG. 2.
Figure 6D:
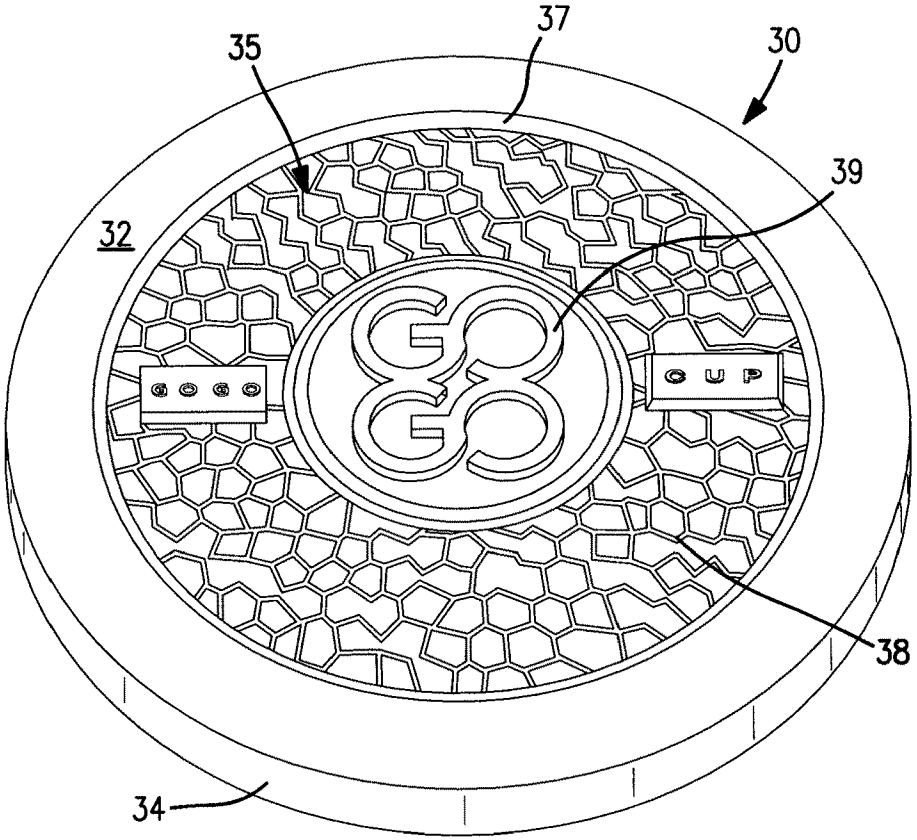
FIG. 6D is a top perspective view of the cover as shown in FIG. 6C with a brand on the cover.
Figure 6C:
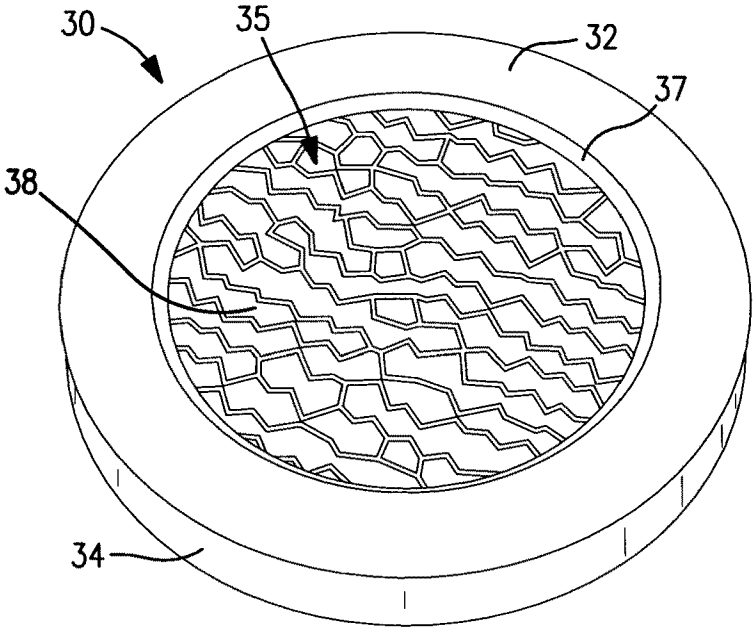
FIG. 6C is a top perspective view of the cover as shown in FIG. 6A.
Figure 7:
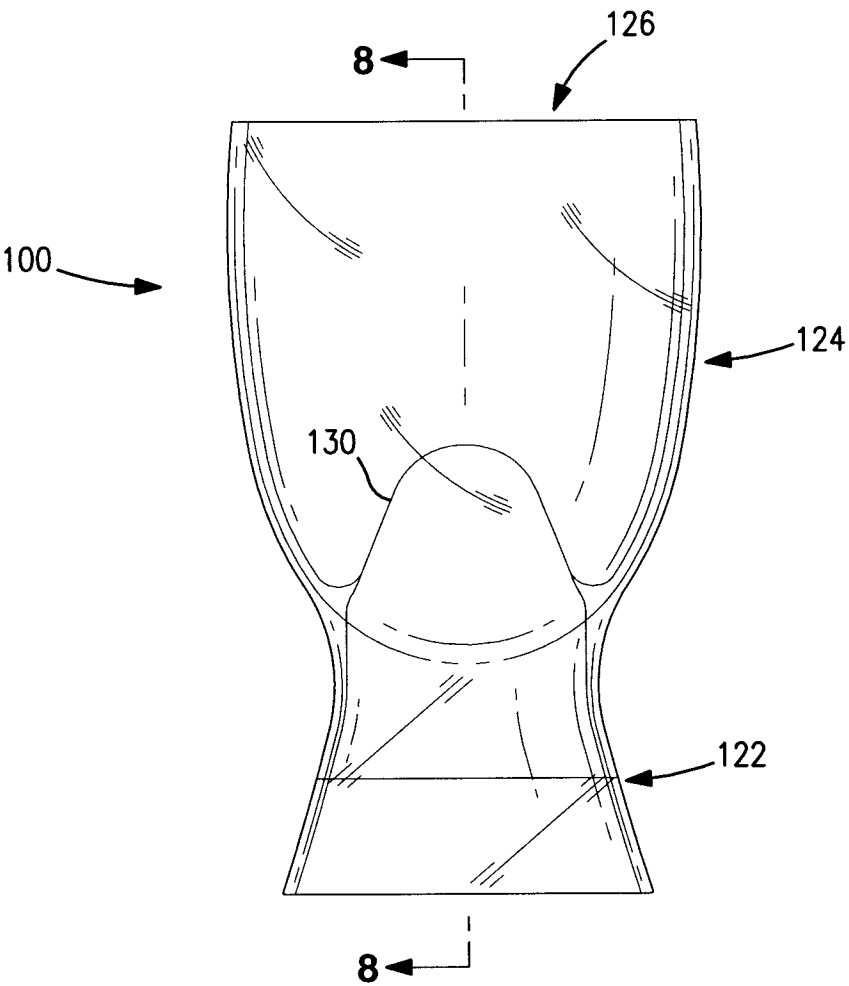
FIG. 7 is an alternative embodiment of the cup similar to FIG. 1 and having a punt base.

Cover 30 as shown, for example, in FIGS. 1, 6C and 6D, is attached to bowl 24 of cup 20 as described above. The cover 30 may include a top wall 32 and side wall 34. In a presently preferred embodiment cover 30 includes a recessed portion 35 having an annular shoulder 37. The recessed portion may include a textured area 38 as shown in FIG. 6C. The textured area 38 may further include a logo and brand name 39, e.g. GOGO™, as shown in FIG. 6D.

The cup 20 is preferably made of a polymer material, a preferred polymer being a polyethylene terephthalate ("PET") material. A preferred PET material may include oxygen inhibitors to preserve and/or extend the wine shelf life. The PET material gives the cup a feeling of a glass container; may be transparent; will not break; and is recyclable. Additionally, the preferred PET material provides a barrier which limits the oxygen penetration and provides for a longer shelf life for the wine. A preferred weight of the cup is in the range of 68 to 75 grams, a preferred weight being 72 grams. This provides a delicately balanced weight to provide a sturdy container while at the same time providing the consumer with a pleasant experience in drinking the wine, similar to drinking from a fine wine glass.

In a preferred embodiment, the diameter of the bowl 24 at top wall 54 is larger than the diameter of the base 22 at bottom wall 40. A preferred diameter of bowl 24 is about 2.83 inches and a preferred outside diameter of the base 22 is about 2.34 inches. In such cases, the cover 30, when removed, may be used as a coaster for placing the base 22 on the underside of the cover 30.

Referring to FIGS. 6A and 6B, the cup 20 is covered with a package 60, e.g. a wrapping material. The wrapping 60 is preferably shrink wrapped onto the cup 20 providing no wrinkles and providing an aesthetically pleasing appearance. The wrapping 60 may include a brand name and/or brand logo and/or other information. The wrapping 60 shields the wine from light and preserves the integrity of the wine. The wrapping 60 may cover a portion of cover 30. When the cup is ready to be opened, the wrapping 60 is removed. In a preferred embodiment and as shown in FIG. 6B, underneath the wrapping 60, cup 20 includes a second package 62 which includes a brand name and/or a brand logo and/or the varietal of the wine and/or other information. As further shown in FIG. 6B, the cup 20 may also include a frosted portion 22A having a brand logo 64. In another aspect of the invention, the brand logo 64 of the base 22 may be raised to provide a grip member for grasping the base when drinking the wine.

In a presently preferred embodiment, the cup 20 may be transparent similar to a traditional wine glass. However, the cup 20 may also have a translucent color or opaque color. Additionally, the cup 20 may be multi-colored, e.g. a base 22 of a translucent color and a transparent bowl 24. Additionally, the cover 30 may be of the same color or different color and may include a design on its underside (not shown) which will be seen when the cover is used as a coaster.

In a preferred embodiment, when using the single serve beverage container, the wrapping material 60 is removed from the container and the cover 30 and foil 28 are thereafter removed. The wine is then ready to be sipped and enjoyed.

Referring to FIGS. 7 and 8, there is shown a presently preferred embodiment of the design of the invention. In this embodiment, there is shown a cup 100 which includes a base 122, a bowl 124 and an opening 126. This cup, similar to that in FIGS. 1-6, may also include a seal 28 and a cover 30 (not shown). The other aspects of cup 100 are substantially similar to cup 20 and are not repeated herein. In this embodiment, the cup 100 further includes a punt base 130 in bowl 124. The punt base serves a number of functions including allowing the control of the head space for the wine; allowing the wine to be closer to the cover (not shown) which thereby lessens the head space and lessens the amount of oxygen in the single serve wine cup; provides an aesthetically pleasing appearance; provides for ease of filling the cup with wine as the wine hits the cone-shaped top of the punt base and spreads more evenly into the cup; provides more storage in the base 122 of the cup when storage is desired; creates the ability to make a larger cup and carry the same amount of wine as required by United States law and International law; and other additional benefits. The punt base 130 may include indicia such as a brand, a logo and a design (e.g. a diamond shaped punt base) such that the indicia may be seen by the user. The dimensions of cup 100 in a presently preferred embodiment are as follows: the height of the cup is about 4.7 inches; the diameter of the top wall of the bowl is about 2.9 inches; the diameter of the bottom wall of the base is about 2.34 inches; and the punt base may be about 0.83 inches in height.

FIGS. 9-11 show another preferred embodiment of the cup invention with a miniature liquor bottle. In this embodiment, there is a cup 200 having a base 222, a bowl 224, an opening 226 (covered by the cover 230 and foil 228), a foil 228, a cover 230, a closure 232 and a cavity 234. The base 222 and bowl 224 are similar to the base 22 and 122 and the bowl 24 and bowl 124 as described above and are not repeated herein except as they differ due to cavity 234 and which will be understood by those skilled in the art. The cavity 234 includes a vertical side wall 236 and top wall 238 adapted to receive liquor bottle 240. The cover 230 is similar to cover 30 as shown, for example, in FIGS. 6C and 6D. As shown in FIGS. 9-11, the cup has a closure 232 for enclosing a miniature liquor bottle 240 in the cavity 234. The closure 232 may include a closure mechanism to hold the closure 232 to the cup 200 such as a tongue in groove mechanism (not shown), friction fit or other closure mechanisms. Additionally, the inside of the closure 232 may have a means for holding the miniature liquor bottle 240 in a non-movable position such as an upwardly extending annular vertical wall 250 adapted to mate with the bottom of liquor bottle 240. In the alternative, other means may be used to hold the liquor bottle 240 in place including a recessed area in closure 232, sizing the cavity such that the liquor bottle fits snuggly in the cavity or other similar means.

As referred to above, the cup 200 may be used to prepare a cocktail such as a margarita. The cavity 234 may hold a miniature liquor bottle 240 of tequila. The bowl 224 will include a margarita mix MM as shown in in FIG. 9. The closure 232 is removed from the cup 200 and the bottle 240 is taken out from base 224. Thereafter, cover 230 and seal 228 are removed and the tequila is poured into the bowl 224 containing the margarita mix, thereby providing for a margarita cocktail.

Figure 12:
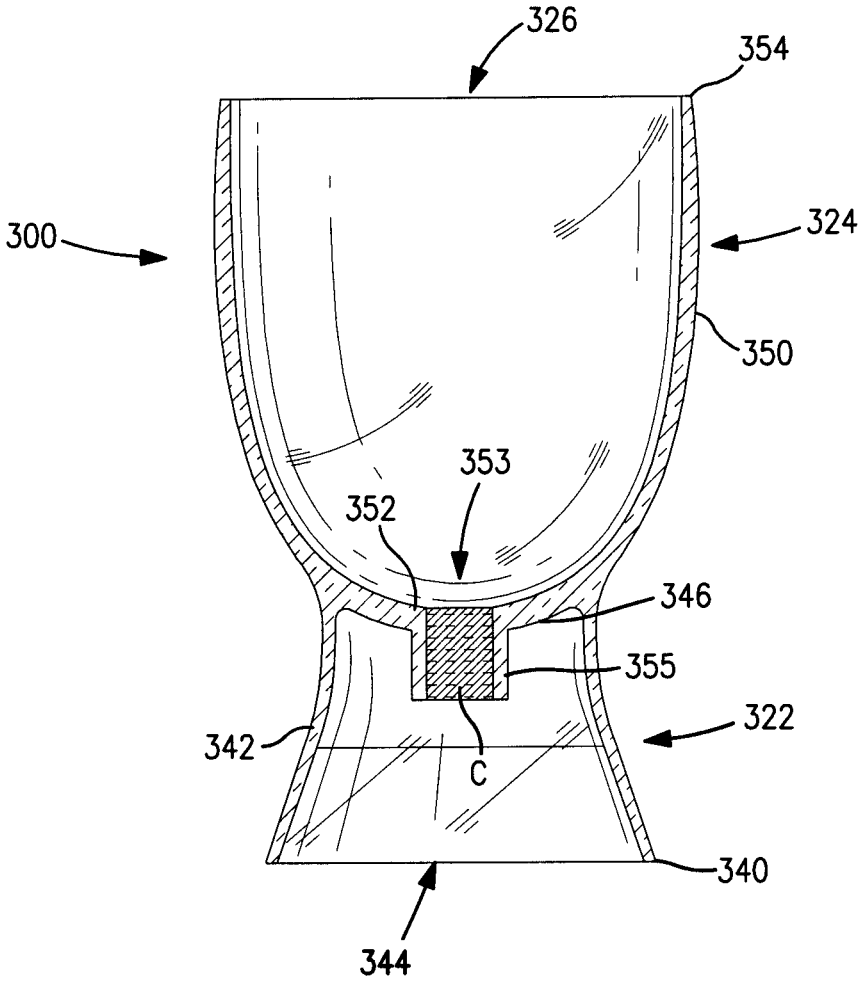
FIG. 12 is another alternative embodiment of the invention showing a cup similar to FIG. 1 in cross-section and having an opening in the bottom of the bowl for filling the wine and receiving a cork after the wine is filled into the cup.
Figure 13:
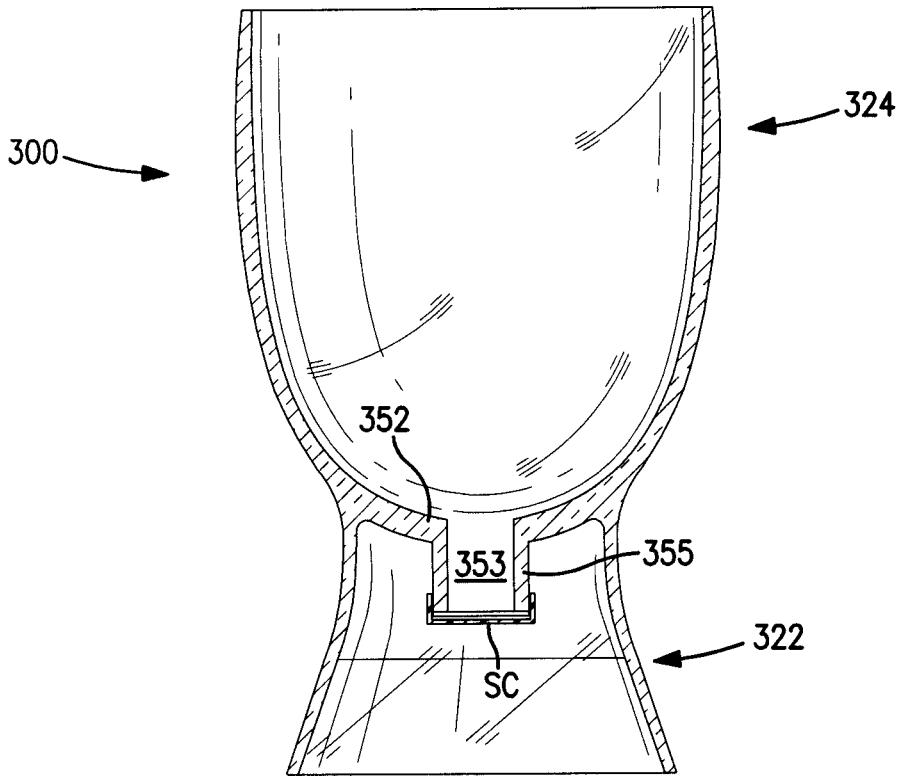
FIG. 13 is an alternative embodiment to FIG. 12 wherein the wine is filled from the bottom of the bowl of the cup and has a screw cap as opposed to a cork.
Figure 14:
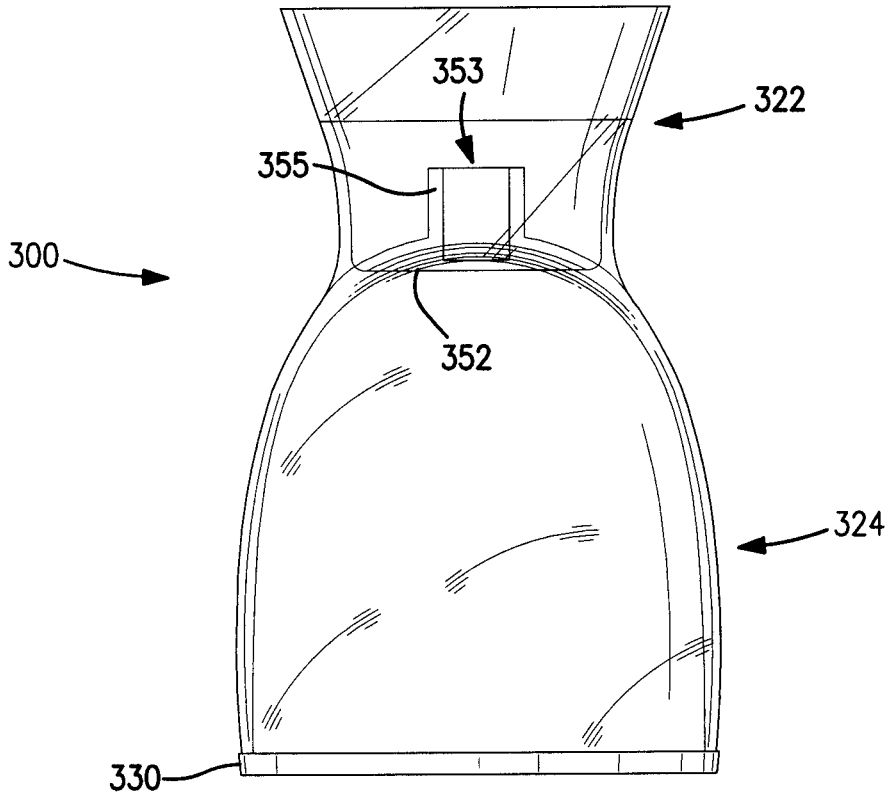
FIG. 14 shows the cup of FIG. 12 having the cover attached to the cup and without the cork and inverted for filling with wine in a conventional wine filling system and thereafter inserting a cork.
Figure 15:
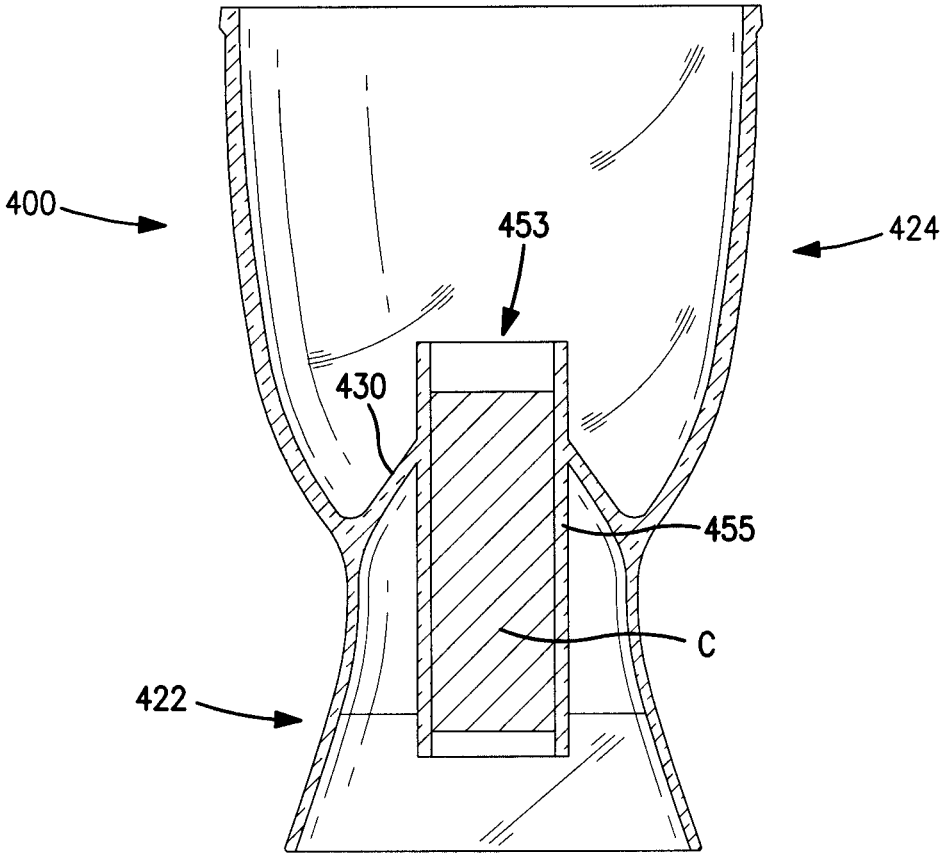
FIG. 15 shows a cup similar to FIGS. 7 and 8 having a punt base in the bottom of the bowl and having an opening for filling wine into the cup in a conventional filling line and then inserting a cork.

As referenced above, the cups in FIGS. 1-8 are intended to fill the wine from the top of the cups 20 and 100 and then close the cup, for example, by foils 28 and 128 and covers 30 and 130. Alternative embodiments of these cups are shown in FIGS. 12-15 wherein the cup may be filled using a conventional filling line for a wine bottle utilizing a cork or screw cap to enclose the cup after the cup is filled. Referring to FIG. 12, there is a cup 300 which is substantially similar to cup 20 of FIG. 1 and is shown in cross-section. Cup 300, like cup 20, includes a base 322 and bowl 324 having similar attributes as cup 20 and which are not repeated in detail herein. Cup 300 includes an opening 353 comprising an annular wall 355 in the bottom wall 352 of the bowl 324 for filling the wine and receiving a cork C after the wine is filled into the cup 300. FIG. 13 is an alternative embodiment to FIG. 12 wherein the wine is filled from the bottom of the bowl 324 of the cup and has a screw cap SC as opposed to a cork. FIG. 14 shows the cup 300 of FIG. 12 having a cover 330 attached to the cup without the cork and inverted for filling with wine in a conventional wine filling system and thereafter inserting a cork. FIG. 15 shows a cup 400 similar to FIGS. 7 and 8 having a base 422 and bowl 424. The cup 400 is substantially the same as cup 100 and the other aspects of cup 400 will not be repeated in detail herein. Cup 400 includes punt base 430 in the bottom of the bowl 424 and having an opening 453 comprising an annular wall 455 for filling wine into the cup in a conventional filling line and then inserting a cork C.

More particularly, referring to FIGS. 12 and 13, there is shown a cup 300 having similar attributes as the cup shown in FIG. 1 and including a base 322, a bowl 324, an opening 326, a seal (not shown) and a cover (not shown). The seal and cover are similar to that shown in FIG. 1 and described above. The base 322 has a bottom wall 340, a side 342 and an opening 344 and a top wall 346 which is the outside portion of the bottom of the bowl 324. The bowl 324 includes a side wall 350, a bottom wall 352 and a top wall or lip 354. The cup is first closed with, for example, a foil seal (not shown) and a cover 330, similar to that shown in FIG. 1. Once the cup is closed, the cup is inverted as shown in FIG. 14 and may be filled by a conventional wine filling system through opening 353 in bottom wall 352. The opening 353 includes an annular wall 355 for receiving a cork C after the cup is filled as shown in FIG. 12. The cup is filled through the opening 353 and thereafter a cork C is inserted into opening 353 to close the cup. When utilizing the single serve cup 300, the cover 330 is taken off and the seal 28 removed. It is understood that the opening 353 may be of different configurations wherein the annular wall 355 is on the outside of the bowl 324, or on the inside of the bowl 324 or on both the inside and the outside of bowl 324.

Referring to FIG. 13, there is shown an alternative embodiment of the cup 300 wherein the cup is filled with a conventional wine filling system and instead of using a cork to seal the bottom of the cup, a screw cap SC is used. In this instance, the annular wall 355 includes threads for receiving the corresponding threads of the screw cap. By using a conventional wine filling system for the cups shown in FIGS. 12-14, expense is saved by not having to use a special filling line.

Referring to FIG. 15, there is shown a cup 400 similar to the cups shown in FIGS. 7 and 8 having a punt base 430. The punt base serves one or more of the purposes noted above, including serving to control the dimensions and configuration of the cup while receiving the about 187 ml of wine. This embodiment illustrates closing the cup after filling with a cork C, although a screw cup may be used. Further, this embodiment includes an annular wall 455 for receiving a cork C, similar to as disclosed in FIGS. 12-14. The cup of FIG. 15 may be filled similar to as described for the cup of FIGS. 12-14.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by any appended claims.

It is claimed:

1. A single-serve beverage cup comprising a base, a bowl, a seal and a cover, wherein said base extends with curvature downwardly from said bowl and comprises a bottom wall, a side wall and a top wall constructed and arranged to form an open bottom area in said base and the diameter of said base decreases from said bottom wall of said base to said top wall of said base, wherein said bowl comprises a bottom wall, a side wall and a top wall constructed and arranged to form an opening at said top wall for receiving a beverage and said bottom wall of said bowl substantially corresponds to said top wall of said base and the diameter of said bowl increases from said bottom wall of said bowl to said top wall of said bowl, wherein the diameter of the bottom wall of said base is less than the diameter of said top wall of said bowl, and wherein said seal and cover are constructed and arranged to close said opening of said bowl and retain said beverage in said cup and are adapted to be opened to expose said beverage for drinking.

2. The single-serve beverage cup according to claim 1 wherein said cup is made of plastic.

3. The single-serve beverage cup according to claim 2 wherein said plastic is polyethylene terephthalate.

4. The single-serve beverage cup according to claim 3 wherein said polyethylene terephthalate includes an oxygen inhibitor.

5. The single-serve beverage cup according to claim 4 wherein said seal and cover are attached to said cup by induction sealing.

6. The single-serve beverage cup according to claim 1 wherein said seal and cover are attached to said cup by induction sealing.

7. The single-serve beverage cup according to claim 5 wherein said cup includes a first outer packaging and a second inner packaging.

8. The single-serve beverage cup according to claim 7 wherein said base is opaque and said bowl is transparent.

9. The single-serve beverage cup according to claim 8 wherein said base includes indicia selected from the group consisting of a brand, a logo and a design.

10. The single-serve beverage cup according to claim 9 wherein at least some of said indicia extend outwardly from said base and are adapted to be gripped by a user.

11. The single-serve beverage cup according to claim 1 further including a cover at the bottom wall of said base adapted to close said open bottom area of said base and adapted to enclose an article in said open bottom area of said base.

12. The single-serve beverage cup according to claim 5 wherein the cover is further attached to said cup by screw threads.

13. The single-serve beverage cup according to claim 2 wherein said cup includes an outer packaging shrink wrapped onto the cup.

14. A single-serve beverage cup comprising a base, a bowl, a seal and a cover, wherein said base extends with curvature downwardly from said bowl and comprises a bottom wall, a side wall and a top wall constructed and arranged to form an open bottom area in said base and the diameter of said base decreases from said bottom wall of said base to said top wall of said base, wherein said bowl comprises a bottom wall, a side wall and a top wall constructed and arranged to form an opening at said top wall for receiving a beverage and said bottom wall of said bowl substantially corresponds to said top wall of said base and the diameter of said bowl increases from said bottom wall of said bowl to said top wall of said bowl, wherein at least a portion of said top wall of said base and at least a portion of said bottom wall of said bowl form a punt base in said bowl, wherein the diameter of the bottom wall of said base is less than the diameter of said top wall of said bowl, and wherein said seal and cover are constructed and arranged to close said opening of said bowl and retain said beverage in said cup and are adapted to be opened to expose said beverage for drinking.

15. The single-serve beverage cup according to claim 14 wherein said cup is made of plastic.

16. The single-serve beverage cup according to claim 15 wherein said plastic is polyethylene terephthalate.

17. The single-serve beverage cup according to claim 16 wherein said polyethylene terephthalate includes an oxygen inhibitor.

18. The single-serve beverage cup according to claim 17 wherein said seal and cover are attached to said cup by induction sealing.

19. The single-serve beverage cup according to claim 14 wherein said seal and cover are attached to said cup by induction sealing.

20. The single-serve beverage cup according to claim 18 wherein said cup includes a first outer packaging and a second inner packaging.

21. The single-serve beverage cup according to claim 20 wherein said base is opaque and said bowl is transparent.

22. The single-serve beverage cup according to claim 21 wherein said base includes indicia selected from the group consisting of a brand, a logo and a design.

23. The single-serve beverage cup according to claim 22 wherein at least some of said indicia extend outwardly from said base and are adapted to be gripped by a user.

24. The single-serve beverage cup according to claim 14 wherein said punt base includes indicia selected from the group consisting of a brand, a logo and a design.

25. The single-serve beverage cup according to claim 12 further including a cover at the bottom wall of said base adapted to close said open bottom area of said base and adapted to enclose an article in said open bottom area of said base.

26. The single-serve beverage cup according to claim 18 wherein the cover is further attached to said cup by screw threads.

27. The single-serve beverage cup according to claim 15 wherein said cup includes an outer packaging shrink wrapped onto the cup.

28. A single-serve beverage cup for a drink comprising a base, a bowl, a seal and a cover, wherein said base extends with curvature downwardly from said bowl and comprises a bottom wall, a side wall and a top wall constructed and arranged to form an open bottom area in said base and the diameter of said base decreases from said bottom wall of said base to said top wall of said base, wherein said bowl comprises a bottom wall, a side wall and a top wall constructed and arranged to form an opening at said top wall for receiving a beverage and said bottom wall of said bowl substantially corresponds to said top wall of said base and the diameter of said bowl increases from the bottom of said bowl to said top wall of said bowl, wherein at least a portion of said top wall of said base and at least a portion of said bottom wall of said bowl form a cavity adapted to receive a bottle in said base said bottle having a mix therein, wherein the diameter of the bottom wall of said base is less than the diameter of said top wall of said bowl, and wherein said seal and cover are constructed and arranged to close said opening of said bowl and retain said beverage in said cup and are adapted to be opened to expose said beverage for mixing said mix from said bottle with said beverage to create said drink.

29. The single-serve beverage cup according to claim 28 wherein said cup is made of plastic.

30. The single-serve beverage cup according to claim 29 wherein said plastic is polyethylene terephthalate.

31. The single-serve beverage cup according to claim 30 wherein said polyethylene terephthalate includes an oxygen inhibitor.

32. The single-serve beverage cup according to claim 31 wherein said seal and cover are attached to said cup by induction sealing.

33. The single-serve beverage cup according to claim 28 wherein said seal and cover are attached to said cup by induction sealing.

34. The single-serve beverage cup according to claim 32 wherein said cup includes a first outer packaging and a second inner packaging.

35. The single-serve beverage cup according to claim 28 including a cover at the bottom wall of said base adapted to close said open bottom area of said base and adapted to enclose said bottle in said open bottom are of said base.

36. The single-serve beverage cup according to claim 32 wherein the cover is further attached to said cup by screw threads.

37. The single-serve beverage cup according to claim 28 wherein said cup includes an outer packaging shrink wrapped onto the cup.

* * * * *